United States Patent [19]

Hammond

[11] 4,427,363

[45] Jan. 24, 1984

[54] FLAME RECTIFICATION DETECTORS

[75] Inventor: Paul S. Hammond, Sheldon, England

[73] Assignee: British Gas Corporation, London, England

[21] Appl. No.: 239,201

[22] Filed: Mar. 3, 1981

[30] Foreign Application Priority Data

Nov. 6, 1980 [GB] United Kingdom ..... 8035733

[51] Int. Cl.[3] ..... F23N 5/00

[52] U.S. Cl. ..... 431/66; 431/78

[58] Field of Search ..... 431/78, 69, 80, 24, 431/25, 26, 66, 71, 79

[56] References Cited

U.S. PATENT DOCUMENTS

| | | | |
|---|---|---|---|
| 2,705,296 | 3/1955 | Weber | 431/78 |
| 3,445,172 | 5/1969 | Zielinski | 431/78 |
| 3,610,789 | 10/1971 | Jones | 431/78 |
| 3,610,790 | 10/1971 | Lindberg | 431/78 |
| 3,674,410 | 7/1972 | Wade | 431/78 |
| 3,732,433 | 5/1973 | Lourigan | 431/69 |
| 3,755,799 | 8/1973 | Riccardi | 431/78 |
| 3,766,441 | 10/1973 | Gray | 431/78 |
| 3,840,322 | 10/1974 | Cade | 431/78 |
| 3,847,533 | 11/1974 | Riordan | 431/78 |
| 3,853,455 | 12/1974 | Riordan | 431/80 |
| 3,941,553 | 3/1976 | Bedford | 431/80 |
| 4,019,854 | 4/1977 | Carlson | 431/78 |
| 4,038,019 | 7/1977 | Matthews | 431/78 |
| 4,080,153 | 3/1978 | Wolfe | 431/78 |
| 4,101,258 | 7/1978 | Jacobsz | 431/78 |
| 4,145,180 | 3/1979 | Bendorf | 431/78 |
| 4,242,079 | 12/1980 | Matthews | 431/78 |
| 4,298,335 | 11/1981 | Riordan | 431/78 |
| 4,303,385 | 12/1981 | Rudich | 431/78 |
| 4,318,687 | 3/1982 | Inoue | 431/78 |
| 4,324,542 | 4/1982 | Challet | 431/78 |

*Primary Examiner*—Daniel J. O'Connor

*Attorney, Agent, or Firm*—Oblon, Fisher, Spivak, McClelland & Maier

[57] ABSTRACT

A fail safe controller for a fuel burner has a rectifying probe positioned in the region occupied by the flame when it is burning normally. An alternating current power supply coupled to the probe is periodically interrupted by an inhibit circuit when the flame is burning. The intermittent rectified output from the probe controls the fuel supply by way of a diode pump circuit which ensures fail safe operation as it gives a null output for a steady state input.

1 Claim, 5 Drawing Figures

FIG. 3a. f = 6KHZ

FLAME RECTIFICATION DETECTORS

BACKGROUND OF THE INVENTION

1. Field of the Invention

This invention relates to safety devices for the control of burner fuel supplies and finds particular application in a fail-safe control for a gas burner.

2. Description of the Prior Art

With devices such as water bath heaters employing a burner as the source of heat it is customary to utilise a flame-presence detector to cut off the fuel supply in the event of flame failure. One form of control system used at present relies on thermocouples as flame detectors, but these have a long delay (or drop-out) time (of the order of 30–60 seconds) between flame failure and a positive indication. Current codes of practice demand a maximum total drop-out time of three seconds for self-checking detectors (including the checking time) or one second for non-self-checking detectors and thermocouple controlled safety devices are generally no longer considered satisfactory for industrial applications.

Alternative safety devices which have a faster response time rely on the fact that a burning flame contains ions and is thus electrically conductive. When the flame is burning, a current can be made to flow between electrodes in contact with the flame and detection of this current provides an indication of satisfactory functioning. With asymmetric electrodes, current flow is not the same in both directions and a rectification effect is observed. This can be utilised to provide a more precise safety device, but it is still necessary to provide ancillary circuits to ensure that the operation is fail-safe, that is, any flame failure resulting in cut-off of the fuel supply.

SUMMARY OF THE INVENTION

Accordingly the present invention provides a safety device for controlling the flow of fuel to a burner comprising an alternating current power supply, probe means disposed within the region occupied by a normally-burning flame and connected to said power supply, earth electrode means positioned adjacent to said region to complete a conduction path through a normally-burning flame, direct current detector means connected to said probe means to detect a rectified alternating current indicative of the presence of a normally-burning flame, inhibiting circuit means connected to said detector means and to said power supply periodically to interrupt the output from said power supply on detection of direct current flow by said detector means and fuel flow control means connected to said detector means to control the flow of fuel to said burner.

BRIEF DESCRIPTION OF THE DRAWINGS

The invention will now be particularly described with reference to the accompanying drawings in which:

FIGS. 3*a–c* are a series of waveforms used to explain the operation of the circuit of FIG. 2.

DETAILED DESCRIPTION OF THE PREFERRED EMBODIMENTS

Figure 1:
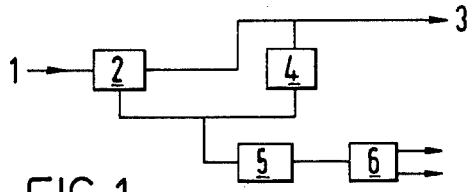
FIG. 1 is a block circuit diagram of a rectifying probe biasing and control circuit

Referring now to FIG. 1 of the drawings, an alternating current bias voltage of 250 V and frequency 6 KHz is derived from a 12 V battery supply 1 by means of an inverter 2. The bias voltage is coupled to a probe 3 which is disposed within the region occupied by the flame of a burner when it is burning normally (not shown). The probe and corresponding earth electrode are asymmetric, resulting in rectification of the AC bias current. The rectified current is detected by a detector circuit 4 which is coupled to an output drive 5 and an inhibit input of the inverter 2. When sufficient charge has been accumulated by the detector, its output is switched, thus inhibiting the inverter. The inhibiting of the inverter means that a rectified current is no longer produced by the flame and the DC detector output switches again allowing the inverter to restart. The process is continuously repeated while a flame is present. When a flame is not present, a rectification signal is not produced and the inverter is maintained running.

As normally a rectified AC signal is being detected, short-circuiting of the probe or its associated wiring will not produce a voltage in the detector circuit and will result in no-flame indication.

The fluctuating inhibit signal produced when a flame is present is used to drive a flame-control relay circuit 6. The output driver 5 comprises a diode pump arrangement which indirectly couples the flame control circuit 6 to the detector output so that only a fluctuating output from the detector can set the output to the "flame" condition.

Figure 2:
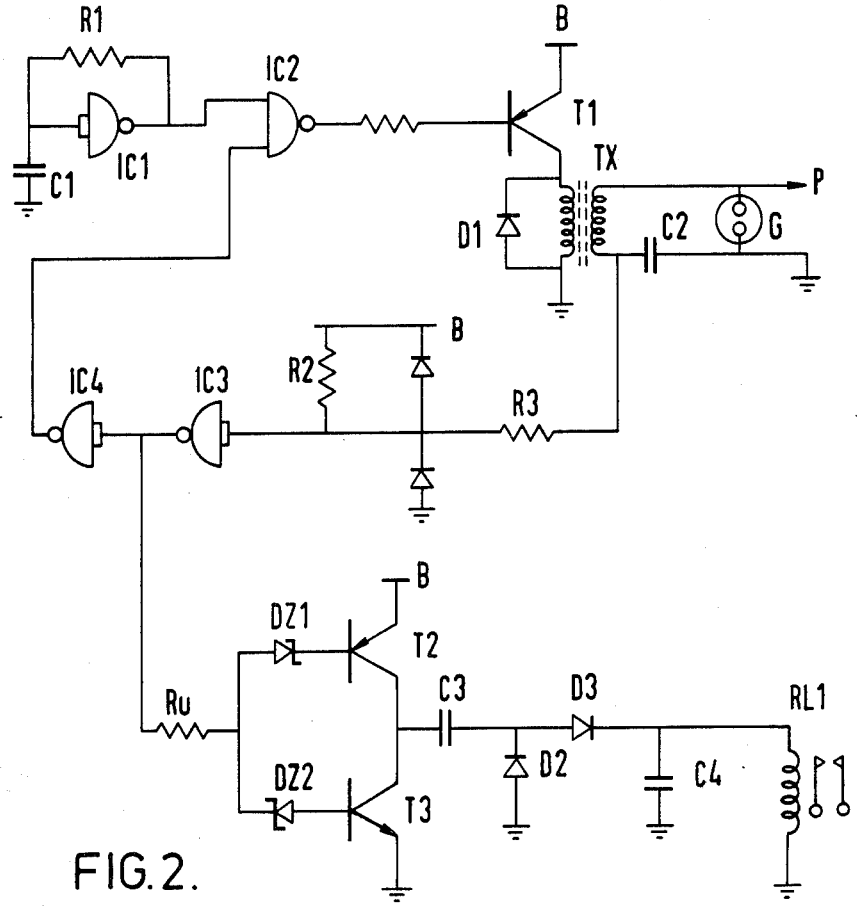
FIG.2 is a diagram showing in detail the circuit of FIG. 1

A practical embodiment of the circuit is shown in FIG. 2. An integrated circuit IC1, resistor R1 and capacitor C1 form a square-wave oscillator running at approximately 6 KHz. The oscillator is coupled to one input of a NAND gate IC2, the output of which feeds the base of a switching transistor T1 connected across a battery B. The collector circuit of the transistor contains the primary of a 1:20 step-up transformer TX and a clamping diode D1. The secondary of the transformer is indirectly coupled to a flame probe P by way of a capacitor C2 which is charged by the rectified current when a flame is present. A spark gap G is connected across the probe for overvoltage protection. The capacitor C2 is coupled to a second input of NAND gate IC2 by way of two further gate circuits IC3,IC4 and provide an inhibit signal to the gate. The repetition rate of the signal is determined by the resistance of a pair of resistors R2,R3 and the capacitance of the capacitor C2, together with the trigger level of the input gate IC3. It has been found that between ten and eleven checks of the flame per second provides satisfactory operation although this is not critical. Smaller component values give rise to more checks per second and vice versa.

Figure 3B:
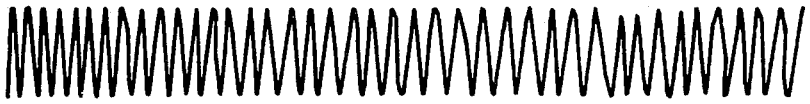
Figure 3B:
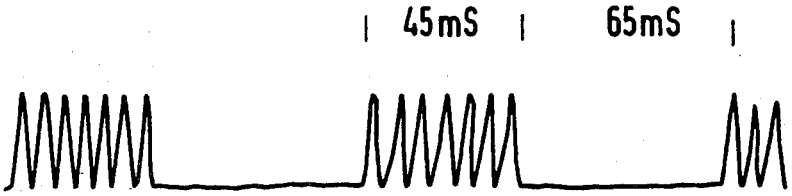
Figure 3C:
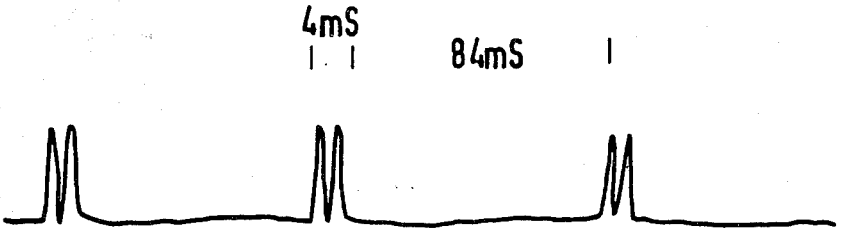

The signal from the probe capacitor C2 is a square wave of substantially constant repetition rate but varying mark-space ratio determined by the flame size. (A strong flame signal causes the capacitor to be charged more rapidly to the trigger level than does a weak signal.) The input signal is shown in FIG. 3*a* and the output signals for weak and strong flames are shown in FIGS. 3*b* and 3*c* respectively.

The output signal from the gate IC3 coupled to capacitor C2 is used to control a diode pump circuit comprising a pair of complementary transistors T2,T3 capacitors C3,C4 diodes D2,D3 resistor R4 and input zener diodes DZ1,DZ2. In operation this pump circuit will not permit the flame control relay RL1 to hold in with a steady input signal, thereby providing fail-safe operation.

The drop-out time is determined by the magnitudes of capacitors C3,C4 in the pump circuit and the impedance of the flame control relay. Their values are chosen experimentally to permit the relay to remain energised for a wide range of flame sizes and yet still give acceptable drop-out times.

Whilst particular circuit arrangements have been described it will be appreciated that various modifications may be made without departing from the ambit of the invention. For example, it is not necessary that the fuel supply to the flame be controlled by a relay and the discrete components of the diode pump circuit may be replaced by an integrated circuit.

I claim:

1. A safety device for controlling the flow of fuel to a burner comprising:

an alternating current power supply;

a probe means disposed within the region occupied by a normally-burning burner flame and connected to said power supply;

ground electrode means positioned adjacent to said region to complete a conduction path through a normally-burning flame;

direct current detector means including a capacitor which is charged when a flame is present which detector means is connected to said probe means to detect a rectified alternating current indicative of the presence of a normally-burning flame;

inhibiting circuit means connected to said detector means and to said power supply periodically to interrupt the output from the power supply upon detection of direct current flow by said detector means wherein said inhibiting circuit means includes a gating means and a resistor means whereby the repetition rate of an inhibit signal is determined by the resistance of said resistor means and the capacitance of said capacitor as well as the trigger level of said gate means;

fuel flow control means connected to said detector means to control the flow of fuel to said burner whereby said fuel flow control means includes a diode pump circuit providing a null output in response to a steady-state input signal; and flame control circuit means including a relay means which acts in response to the output of said pump circuit to thereby provide control of said flow of fuel to said burner.

* * * * *